US012599826B2

(12) United States Patent
Birmingham et al.

(10) Patent No.: US 12,599,826 B2
(45) Date of Patent: Apr. 14, 2026

(54) RAGE RELIEVING DEVICE

(71) Applicant: The Rage Pad LLC, Denver, NC (US)

(72) Inventors: Cort Birmingham, Denver, NC (US); Hamilton Van Sciver, Charleston, SC (US); Destin Wesley Huggins, Denver, NC (US)

(73) Assignee: The Rage Pad LLC, Denver, NC (US)

( * ) Notice: Subject to any disclaimer, the term of this patent is extended or adjusted under 35 U.S.C. 154(b) by 341 days.

(21) Appl. No.: 18/131,358

(22) Filed: Apr. 5, 2023

(65) Prior Publication Data

US 2023/0311008 A1 Oct. 5, 2023

Related U.S. Application Data

(60) Provisional application No. 63/327,525, filed on Apr. 5, 2022.

(51) Int. Cl.
*A63B 69/20* (2006.01)
*A63B 69/32* (2006.01)

(52) U.S. Cl.
CPC ..... *A63B 69/20* (2013.01); *A63B 69/32* (2013.01)

(58) Field of Classification Search
CPC ..... A63B 69/20; A63B 69/22; A63B 69/02; A63B 69/322; A63B 69/325; A63B 69/26; A63B 69/215; A63B 69/224; A63B 69/24; A63B 69/244; A63B 69/28; A63B 69/30; A63B 69/305; F41H 5/08
See application file for complete search history.

(56) References Cited

U.S. PATENT DOCUMENTS

| | | | | |
|---|---|---|---|---|
| 7,004,886 | B2 | 2/2006 | Chen | |
| 9,545,542 | B2 * | 1/2017 | Binder | A63H 29/24 |
| 10,173,119 | B2 * | 1/2019 | Muhammad | A63B 69/26 |
| D889,579 | S * | 7/2020 | Bentley | A63B 69/34 D21/788 |
| 11,426,643 | B2 * | 8/2022 | Duffy | A63B 69/22 |
| 11,583,744 | B1 * | 2/2023 | Hayes | A63B 69/20 |
| 2003/0148860 | A1 | 8/2003 | Wren | |
| 2012/0157246 | A1 * | 6/2012 | Glover | A63B 69/00 473/570 |
| 2018/0178103 | A1 * | 6/2018 | Zhang | A63B 69/32 |
| 2021/0394034 | A1 | 12/2021 | Waters | |

* cited by examiner

*Primary Examiner* — Megan Anderson
(74) *Attorney, Agent, or Firm* — TILLMAN WRIGHT, PLLC; Chad D. Tillman

(57) ABSTRACT

A device includes a pad having an outermost upper surface for receiving a hand strike and an outermost bottom surface defining a recess extending upward into the pad and defining a central interior space of the pad; a base removably attached to the pad in covering relation to the recess defined in the bottom surface so as to close off the central interior space; and an electronics module located within the central interior space. The electronics module preferably is configured to detect a hand strike received on the outermost upper surface of the pad and play through a speaker, upon the detection of the hand strike, an audio response. The electronics module includes a sensor for detecting the hand strike. The sense may be an accelerometer or vibration sensor. Additional embodiments of the device also are disclosed.

16 Claims, 6 Drawing Sheets

RAGE RELIEVING DEVICE

COPYRIGHT STATEMENT

Any new and original work of authorship in this document is subject to copyright protection under the copyright laws of the United States and other countries. Reproduction by anyone of this document as it appears in official governmental records is permitted, but otherwise all other copyright rights whatsoever are reserved.

BACKGROUND OF THE INVENTION

The invention generally relates to a novelty apparatus and, in particular, to a fun and therapeutic device for relieving rage and managing anger.

A rage relieving device is disclosed in U.S. patent application no. 2021/0394034 A1 ("the '034 Publication"), the disclosure of which is incorporated herein by reference. The known device is designed to receiving physical hand strikes from a user in pounding-like motions. Such actions are believed to enable the user to unleash and release the user's rage. Such device can be used, for example, by a gamer during times of high stress during game play. This known device comprises a central area that branches off into discrete striking pads or endpoints, each being separated from each other and connected only by the central area whereby each endpoint provides independent functionality. In this respect, each endpoint comprises a sensor that detects when the endpoint is pounded and the force with which the endpoint is pounded. Hardware components including a processor, memory, and one or more speakers are contained within the central area. The sensor in each endpoint transmits a signal by which the hardware components cause a sound to be played at a volume that correlates to the force with which the endpoint is pounded. A different sound may be played for each endpoint. The device further comprises an outer layer that completely encapsulates the device and a central interior layer that surrounds and protects the hardware components within the central area. The central interior layer preferably comprises microbeads. Each sensor in an endpoint preferably is positioned against an upper interior layer adjacent the outer layer for detecting impacts. The upper interior layer preferably is foam, and the outer layer preferably is a light-weight cotton twill. The outer layer defines both the outer top surface and the outer bottom surface.

It will be appreciated that because of the physical separation of the hardware components in the central region from the sensors in the endpoints, the rage relieving device of the '034 Publication has a large footprint for use on a desk or other surface of a gamer. Replacement of a faulty sensor or hardware component also may be complicated by this. Furthermore, the rage relieving device includes a dead space in the central region, which does not include any sensor for detecting striking of the central region; the central region where the hardware components are located is not intended to be struck or pounded.

In view of the foregoing, it is believed that the construction of the rage relieving device of the '034 Publication is overly complex in its construction and that a need exists for improvement in such rage relieving devices. This is believed to be addressed by one or more aspects and features of the invention.

SUMMARY OF THE INVENTION

The invention includes many aspects and features. Moreover, while many aspects and features relate to, and are described in, the context of gamers, the invention has broader utility. For example, the invention has utility for sports fans and can be used while watching a frustrating sporting event on a display. The invention further has utility for drivers to help lessen road rage. And while the device may be positioned on a desktop surface or tabletop surface, the device may alternatively be mounted or adhered to vertical surfaces such as a wall, and even may be attached to a center console or dash of a vehicle for combatting road rage.

In an aspect of the invention, a device comprises: a pad having an outermost upper surface for receiving a hand strike and an outermost bottom surface defining a recess extending upward into the pad and defining an interior space of the pad; a base removably attached to the pad in covering relation to the recess defined in the bottom surface so as to close off the interior space; and an electronics module located within the interior space. Preferably, the interior space is centrally located within the pad relative to a top plan view of the pad.

Preferably the electronics module is held in tensioned engagement between and in engagement with the pad and the base so as to be able to detect a hand strike received on the outermost upper surface of the pad and play through a speaker, upon the detection of the hand strike, an audio response.

In a feature, the audio response is saved in computer readable memory of the electronics module. Preferably, the electronics module comprises the speaker, and the base comprises openings for transmitting sound from the speaker to an exterior of the device.

In a feature, the speaker is located on an exterior of the device and the electronics module comprises a wireless transceiver for wirelessly playing the audio response on the speaker.

In a feature, the audio response is recorded by a user and saved to a computer readable memory of the electronics module through a communication port of the electronics module.

In a feature, the electronics module is removably received within the central interior space and is self-contained.

In a feature, the pad comprises a foam material enclosed by an outer layer of material. The foam preferably is a high density polyurethane foam having a maximum thickness of around three inches.

In a feature, all electronic components of the device are located within a housing of the electronics module that is received within the enclosed central interior space.

In a feature, the base and pad are removably attached together with hook and loop fasteners.

In a feature, the base comprises a no-slip outwardly facing surface for placement of the device on a desktop surface.

In a feature, the outermost upper surface of the pad comprises a curved surface extending from one side to an opposite side of the device.

In a feature, the pad resembles a concave button.

In a feature, all electronics of the device are contained within a housing of the electronics module and the electronics module is located only in a central area of the pad.

In another aspect, a device comprises: (a) a pad having an outermost upper surface for receiving a hand strike and an outermost bottom surface defining a recess extending upward into the pad and defining an interior space of the pad; (b) an electronics module located within the interior space of the pad; (c) a base removably attached to the pad, the base including an access opening for accessing the electronics module located within the interior space; (d) a removable member located within the access opening for retaining the electronics module within the interior space; and (e) a cover enclosing the pad and the base. The electronics module is configured to detect a hand strike received on the outermost upper surface of the pad and play through a speaker, upon the detection of the hand strike, an audio response.

In a feature of this aspect, the removable member located within the access opening is a plug that frictionally fits within the access opening and closes off the access opening.

In another wherein the cover completely encloses the pad and the base.

Additional aspects and features are disclosed in the drawings, including FIGS. 13-23.

Additional aspects and features are disclosed in provisional U.S. patent application 63/327,525, filed Apr. 5, 2022, the disclosure of which is incorporated herein by reference.

In addition to the aforementioned aspects and features of the invention, it should be noted that the invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the invention now will be described in detail with reference to the accompanying drawings, wherein the same elements are referred to with the same reference numerals.

DETAILED DESCRIPTION

Figure 1:
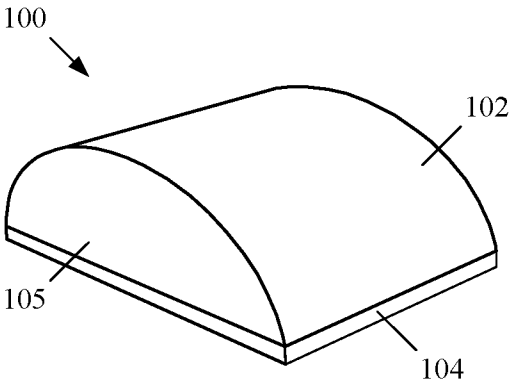
FIG. 1 is a perspective view of a preferred device in accordance with one or more aspects and features of the invention.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once but not necessarily every time during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Referring now to the drawings, one or more preferred embodiments of the invention are next described. The following description of one or more preferred embodiments is merely exemplary in nature and is in no way intended to limit the invention, its implementations, or uses.

Figure 2:
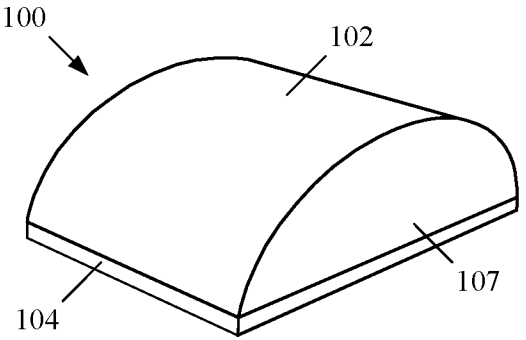
FIG. 2 is another perspective view of the device of FIG. 1.
Figure 3:
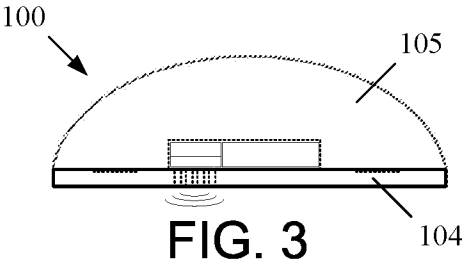
FIG. 3 is an elevational view of a first side the device of FIG. 1.
Figure 4:
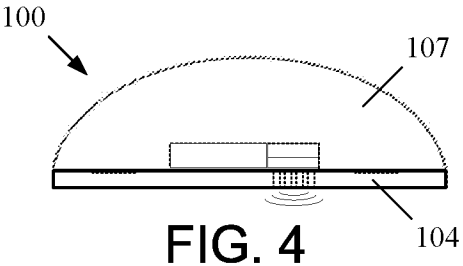
FIG. 4 is an elevational view of a second, opposite side the device of FIG. 1.
Figure 5:
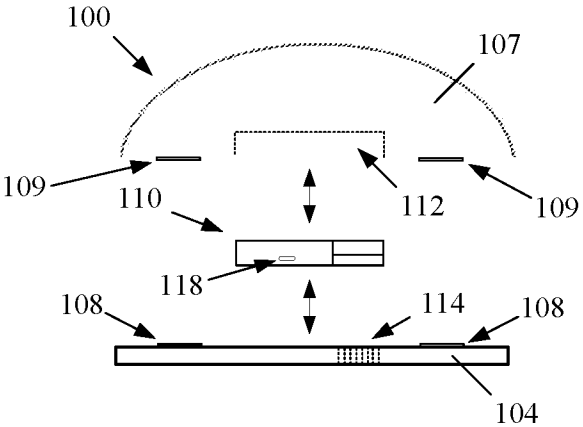
FIG. 5 is an exploded view of the device of FIG. 4.

Turning now to the drawings, FIG. 1 is a perspective view of a preferred device 100 in accordance with one or more aspects and features of the invention. Furthermore, FIG. 2 is another perspective view of the device 100; FIG. 3 is an elevational view of a first side the device 100; FIG. 4 is an elevational view of a second, opposite side the device 100; and FIG. 5 is an exploded view of the device 100 as seen in FIG. 4.

Figure 14:
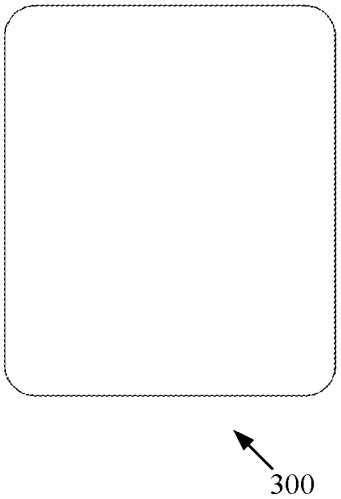
FIG. 14 is a bottom plan view of the device of FIG. 12.

With reference to FIGS. 14, the device 100 comprises: a pad 102 having an outermost upper surface for receiving a hand strike and an outermost bottom surface defining a recess extending upward into the pad and defining a central interior space 112 of the pad; a base 104 removably attached to the pad in covering relation to the recess defined in the bottom surface so as to close off the central interior space; and an electronics module 110 located within the central interior space in tensioned engagement with both the pad and the base.

Figure 6:
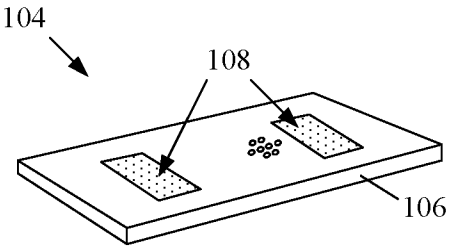
FIG. 6 is a perspective view of the base of the device of FIGS. 1-5.
Figure 7:
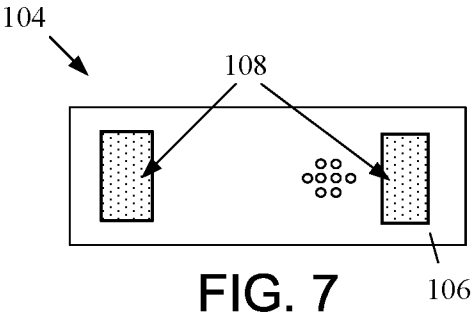
FIG. 7 is a top plan view of the base of FIG. 6.

The base and pad are removably attached together with pairs of adhesive strips of hook and loop fasteners 108,109. The base 104 comprises a no-slip outwardly facing surface for placement of the device on a desktop surface. FIG. 6 is a perspective view of the base 104 of the device 100; and FIG. 7 is a top plan view of the base 104.

The electronics module preferably is removably received within the central interior space and is self-contained, having all of the electronics of the device within a housing of the electronics module. As illustrated in the device 100, the electronics module is located only in a central area of the pad.

The electronics module is configured to detect a hand strike received on the outermost upper surface of the pad and play through a speaker, upon the detection of the hand strike, an audio response. The audio response preferably is saved in computer readable memory of the electronics module. Additionally, the electronics module comprises the speaker, and the base comprises openings 114 for transmitting sound from the speaker to an exterior of the device. Alternatively, the speaker is located on an exterior of the device, and the electronics module comprises a wireless transceiver for wirelessly playing the audio response on the speaker. The audio response that is played preferably is recorded by a user and saved to a computer readable memory of the electronics module through a communication port 118 of the electronics module, such as a USB port.

The pad preferably is comprised of a foam material that is enclosed by an outer layer of a vinyl material, similar to safety wall padding in gyms. The outer layer of material alternatively comprises a smooth faux leather material.

As seen in the drawings, the outermost upper surface of the pad comprises a curved surface extending from one side to a second, opposite side of the device. Opposite third and fourth sides comprise vertical walls.

Figure 8:
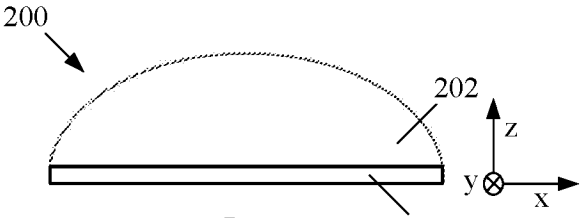
FIG. 8 is a first side elevational view of another preferred device in accordance with one or more aspects and features of the invention.
Figure 9:
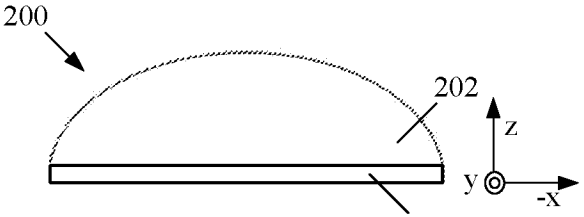
FIG. 9 is a second side elevational view of the device of FIG. 8.
Figure 10:
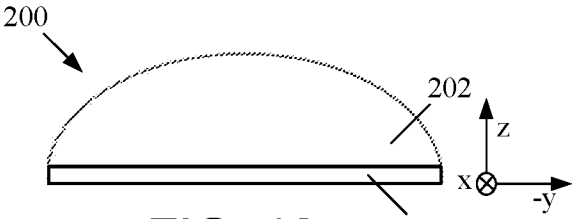
FIG. 10 is a third side elevational view of the device of FIG. 8.
Figure 11:
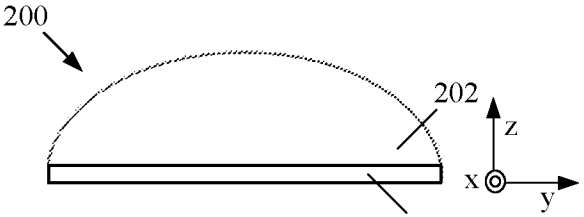
FIG. 11 is a fourth side elevational view of the device of FIG. 8.

Another preferred embodiment 200 is illustrated in FIGS. 8-11. The preferred embodiment in in a shape that resembles a concave button. Device 200 is similar to device 100 and principally differs only in the shape of the pad 202 and base 204. In this respect, FIG. 8 is a first side elevational view of the device 200; FIG. 9 is a second side elevational view of the device 200; FIG. 10 is a third side elevational view of the device 200; and FIG. 11 is a fourth side elevational view of the device 200.

Figure 13:
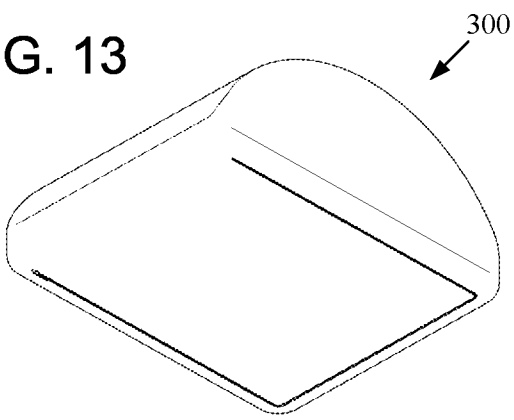
FIG. 13 is a perspective bottom view of the device of FIG. 12.
Figure 17:
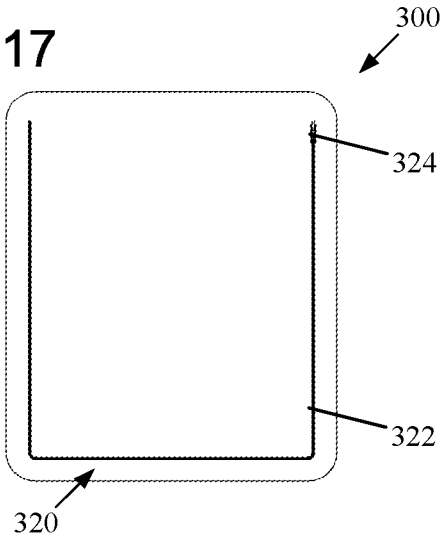
FIG. 17 is a bottom plan view of the device of FIG. 12.
Figure 15:
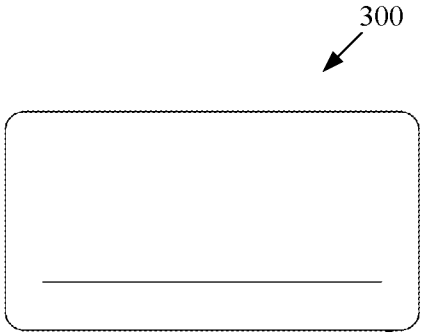
FIG. 15 is a side elevational view of the device of FIG. 12, which is also representative of the opposite side of the device of FIG. 12.
Figure 16:
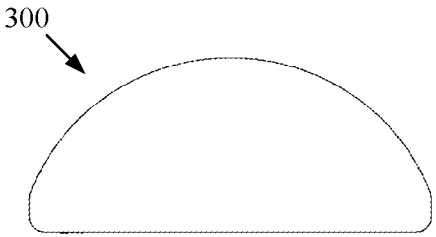
FIG. 16 is a front elevational view of the device of FIG. 12, which is also representative of the back of the device of FIG. 12.
Figure 12:
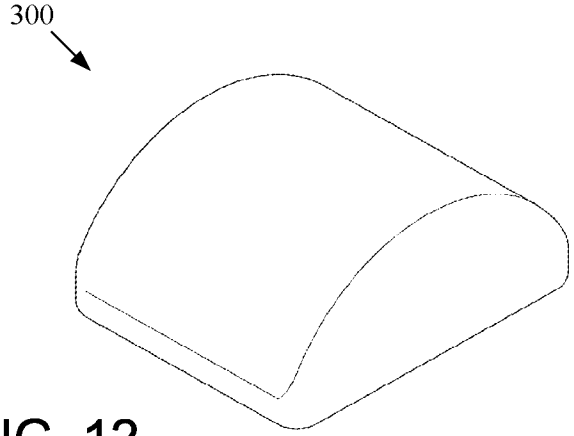
FIG. 12 is a perspective top view of a third preferred device in accordance with one or more aspects and features of the invention.
Figure 19:
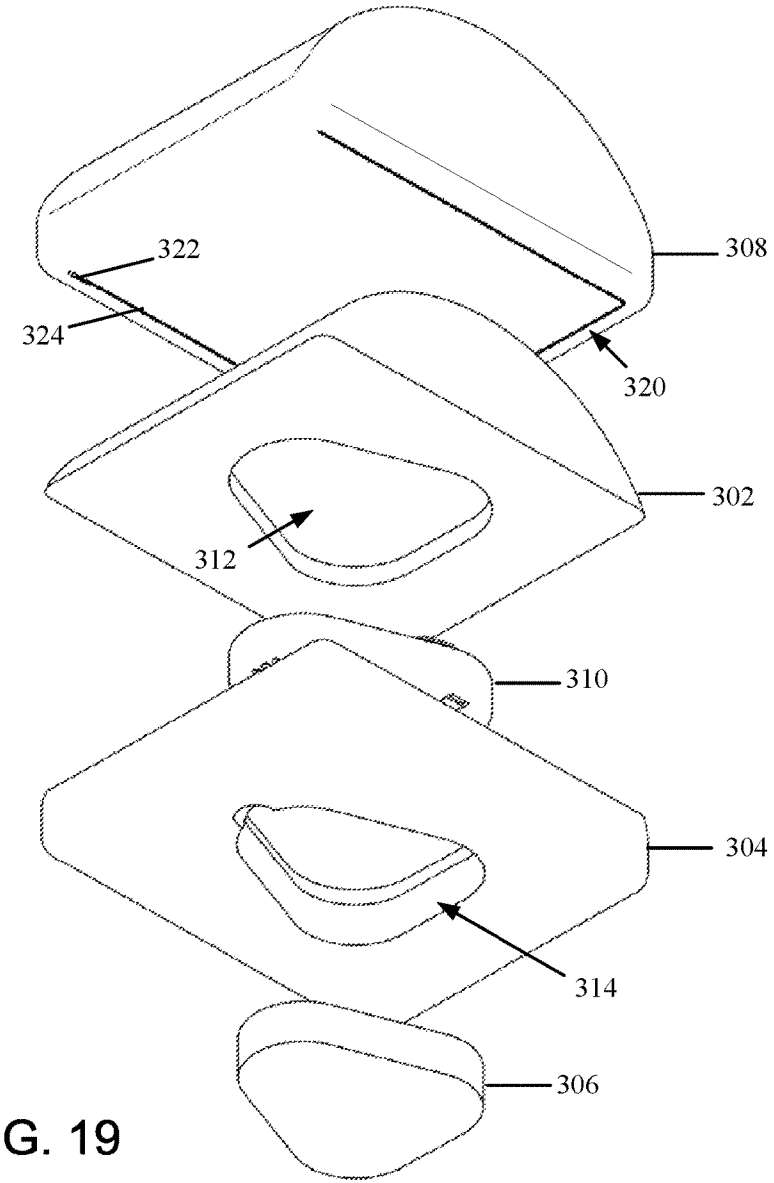
FIG. 19 is an exploded bottom perspective view of the device of FIG. 12.
Figure 18:
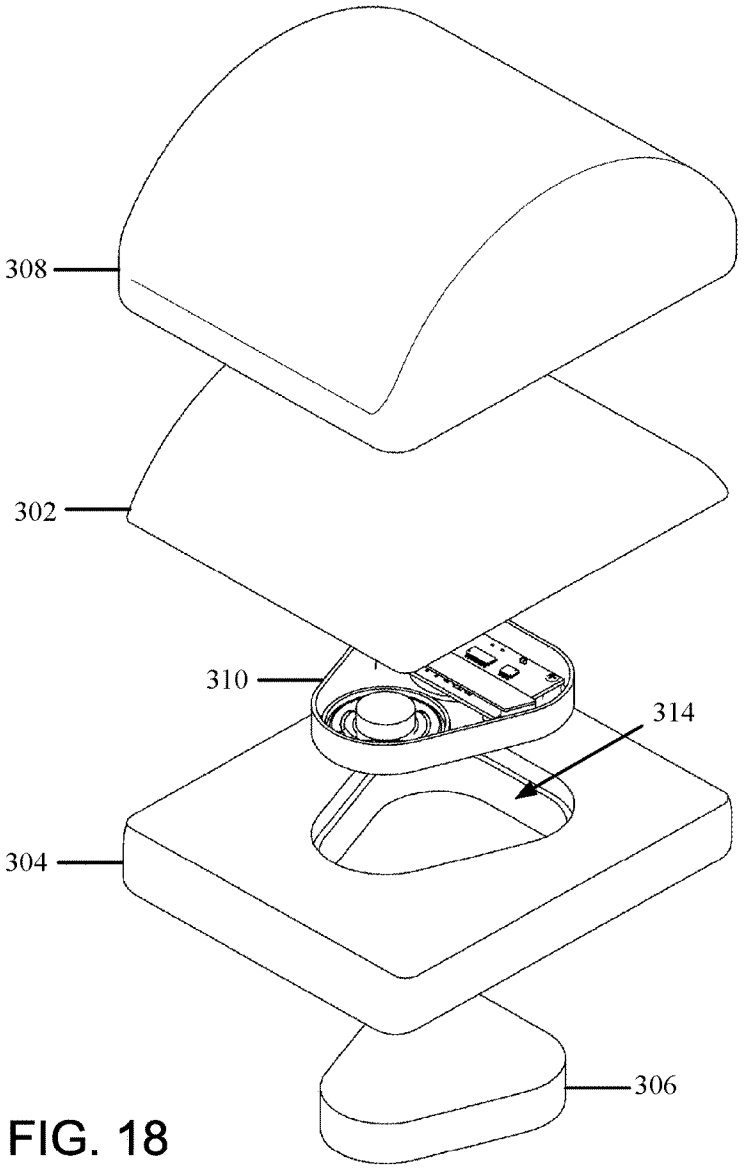
FIG. 18 is an exploded top perspective view of the device of FIG. 12.

FIG. 12 is a perspective top view of a third preferred device 300 in accordance with one or more aspects and features of the invention. Furthermore, FIG. 13 is a perspective bottom view of the device 300; FIG. 14 is a bottom plan view of the device 300; FIG. 15 is a side elevational view of the device 300, which is also representative of the opposite side of the device of FIG. 12; FIG. 16 is a front elevational view of the device 300, which is also representative of the back of the device of FIG. 12; FIG. 17 is a bottom plan view of the device 300; FIG. 18 is an exploded top perspective view of the device 300; and FIG. 19 is an exploded bottom perspective view of the device 300.

The device is similar to device 200 which, in turn, is similar to device 100. Accordingly, the differences found in device 300 are primarily the focus of the description below.

The device 300 comprises: a pad 302 having an outermost upper surface for receiving a hand strike and an outermost bottom surface defining a recess extending upward into the pad and defining a central interior space 312 of the pad; a base 304; and an electronics module 310 located within the central interior space 312.

The base 304 further comprises an access opening 314 that registers with the mouth of the interior space 312 such that the electronics module 310 is accessible through the access opening 314 of the base 304 without removing the base 304 from the pad 302. The device 300 further comprises a plug 306 that is insertable into the access opening 314 for plugging the access opening 314 and covering and retaining the electronics module 310 within the interior space 312.

Preferably the plug 306 is received in frictional fit snugly within the access opening 314 and abuts the electronics module 310 and tensions the electronics module 310 against or into abutment with the pad 302. In this respect, the electronics module 310 is held in tensioned engagement with both the pad 302 and the base 304. In particular, the electronics module 310 preferably remains pressed by the plug 306 into contact with the pad 302 such that compression of the pad 302 from being struck is felt by the electronics module 310 and triggers a desired response by the electronics module 310. In the device 300, the base 304 may be made from the same compressible, resilient material from which the pad 302 is made.

The device 300 further comprises a cover 308 for enclosing the other components of the device 300. The cover 308 preferably is a textile fabric or smooth faux leather material.

A zipper mechanism 320 with slider body 322 and teeth 324 is provided for access to an interior space of the cover 308. The teeth 324 preferably are arranged in a U-shaped pattern. When inserted into the interior space of the cover 308, the cover 308 preferably is form fitting as seen in FIGS. 12-16, and the other assembled components of the device 300 preferably are held together in tensioned compression while enclosed within the cover.

Figure 21:
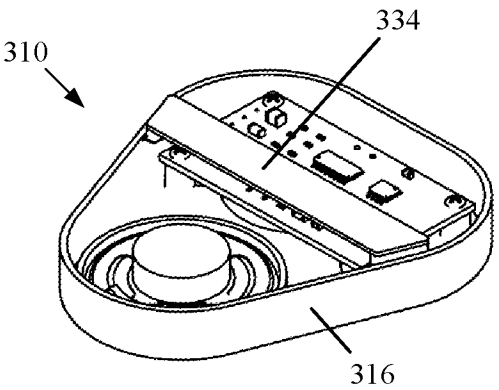
FIG. 21 is a top perspective view of the electronics module of FIG. 20.
Figure 20:
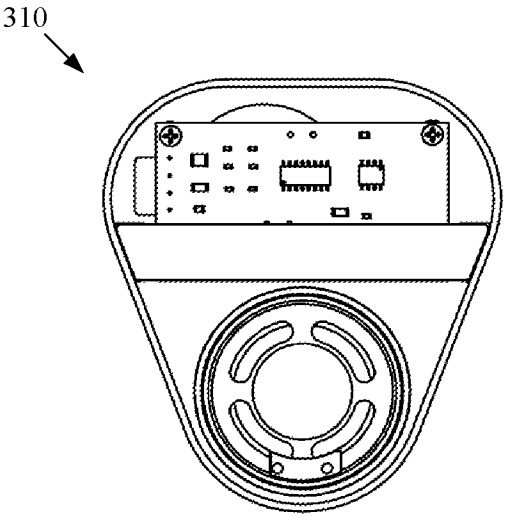
FIG. 20 is a top plan view of an electronics module of the device of FIG. 12.
Figure 23:
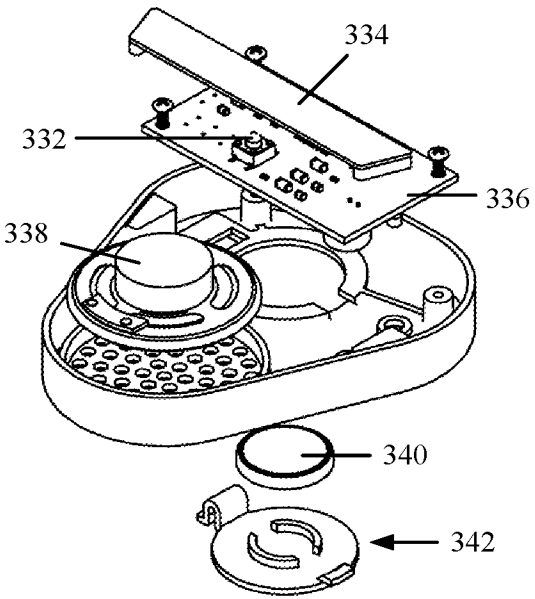
FIG. 23 is an exploded top perspective view of the electronics module of FIG. 20.
Figure 22:
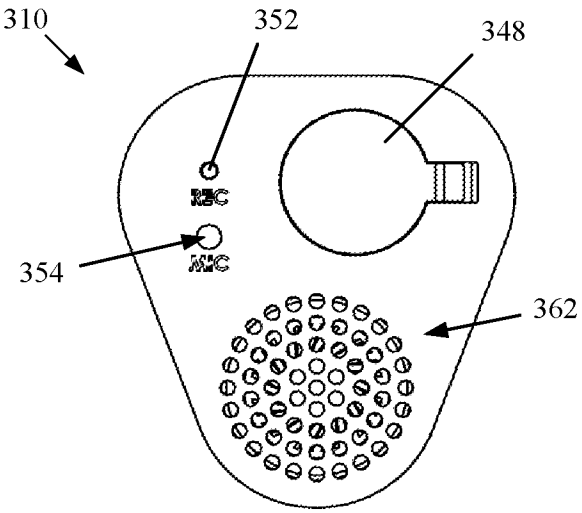
FIG. 22 is a bottom plan view of the electronics module of FIG. 20.

FIG. 20 is a top plan view of the electronics module 310 of the device 300. Furthermore, FIG. 21 is a top perspective view of the electronics module 310; FIG. 22 is a bottom plan view of the electronics module 310; FIG. 23 is an exploded top perspective view of the electronics module 310.

The electronics module 310 is removably received within the central interior space and is self-contained, preferably having all of the electronics of the device within a housing 316 of the electronics module 310.

The electronics module 310 is configured to detect a hand strike received on the outermost upper surface of the pad and play through a speaker, upon the detection of the hand strike, an audio response. The detection of the hand strike may be accomplished, for example, by a vibration sensor or an accelerometer; however, in the device 300 as illustrated, this detection is accomplished by a mechanical system in which a button 332 is pressed when the pad 302 is compressed into a resilient, springy cover band 334. The band 334 bridges the electronics module 310, specifically, a circuit board 336 retained by screws to the housing 316, and in doing so, the band 334 spans the button 332. This is perhaps best understood from FIGS. 21 and 23.

The audio response preferably is saved in computer readable memory of the circuit board 336. Additionally, the electronics module 310 comprises a speaker 338 and a power source in the form of a battery 340 and terminals 342. A batter cover 348 is provided in the housing 316 for changing the battery. Openings 362 are provided in the housing 316 of the electronics module 310 to facilitate hearing of the audio response.

Alternatively, the speaker is located on an exterior of the device, and the electronics module comprises a wireless transceiver for wirelessly playing the audio response on the speaker. The audio response when played externally may be played on a speaker, computer audio, headset, or headphones, just for example, rather than from the speaker 338 of the device 300 itself. In some embodiments, the audio response is played from a combination thereof. The audio response that is played preferably is recorded by a user and saved to a computer readable memory of the electronics module through a communication port 118 of the electronics module, such as a USB port (not shown).

Moreover, when a USB port is provided in the device 300, a USB connection can be utilized to power the device 300, charge the battery 340 if also provided, or both, regardless of whether the USB connection is used to record the audio response. Indeed, as shown in FIG. 22, an audio response may be recorded by pressing a "rec" button 352 and speaking directly into a mic 354 of the electronics module 310.

Based on the foregoing description, it will be readily understood by those persons skilled in the art that the invention has broad utility and application. Many embodiments and adaptations of the invention other than those specifically described herein, as well as many variations, modifications, and equivalent arrangements, will be apparent from or reasonably suggested by the invention and the foregoing descriptions thereof, without departing from the substance or scope of the invention.

Accordingly, while the invention has been described herein in detail in relation to one or more preferred embodiments, it is to be understood that this disclosure is only illustrative and exemplary of the invention and is made merely for the purpose of providing a full and enabling disclosure of the invention. The foregoing disclosure is not intended to be construed to limit the invention or otherwise exclude any such other embodiments, adaptations, variations, modifications or equivalent arrangements, the invention being limited only by the claims appended hereto and the equivalents thereof.

For example, in a contemplated modification of the invention, the response to the hand strike includes activation of one or more lights, such as LED strips, either in addition to an audio response or in place of an audio response. The light connectivity may be wired or wireless. Furthermore, LED lights may also be included in the pad itself and included as part of the base or electronics module.

What is claimed is:

1. A device, comprising:

(a) a pad having an outermost upper surface for receiving a hand strike and an outermost bottom surface defining a recess extending upward into the pad and defining an interior space of the pad;

(b) an electronics module located within the interior space of the pad;

(c) a base removably attached to the pad, the base including an access opening for accessing the electronics module located within the interior space;

(d) a removable member located within the access opening for retaining the electronics module within the interior space; and (e) a cover enclosing the pad and the base;

(f) wherein the electronics module is configured to detect a hand strike received on the outermost upper surface of the pad and play through a speaker, upon the detection of the hand strike, an audio response.

2. The device of claim 1, wherein the electronics module comprises the speaker.

3. The device of claim 2, wherein the base comprises openings for transmitting sound from the speaker to an exterior of the device.

4. The device of claim 1, wherein the removable member located within the access opening is a plug, and wherein the cover completely encloses the pad and the base.

5. The device of claim 1, wherein the audio response is saved in computer readable memory of the electronics module.

6. The device of claim 1, wherein the electronics module comprises a sensor for detecting the hand strike, the sensor comprising an accelerometer or vibration sensor.

7. The device of claim 1, wherein the speaker is located on an exterior of the device and the electronics module comprises a wireless transceiver for wirelessly playing the audio response on the speaker.

8. The device of claim 1, wherein the audio response is recorded by a user and saved to a computer readable memory of the electronics module through a communication port of the electronics module.

9. The device of claim 1, wherein the electronics module is removably received within the interior space and is self-contained.

10. The device of claim 1, wherein the pad comprises a foam material enclosed by an outer layer of material.

11. The device of claim 1, wherein all electronic components of the device are located within a housing of the electronics module that is received within the enclosed interior space.

12. The device of claim 1, wherein the base and pad are removably attached together with hook and loop fasteners.

13. The device of claim 1, wherein the base comprises a no-slip outwardly facing surface for placement of the device on a desktop surface.

14. The device of claim 1, wherein the outermost upper surface of the pad comprises a curved surface extending from one side to an opposite side of the device.

15. The device of claim 1, wherein the pad resembles a concave button.

16. The device of claim 1, wherein all electronics of the device are contained within a housing of the electronics module and the electronics module is located only in a central area of the pad.

* * * * *